US007533680B2

(12) United States Patent
Ma

(10) Patent No.: US 7,533,680 B2
(45) Date of Patent: May 19, 2009

(54) UMBRELLA ASSEMBLY WITH TILT ADJUSTMENT

(76) Inventor: Oliver Joen-an Ma, 29 W. Wisteria, Arcadia, CA (US) 91007

( * ) Notice: Subject to any disclaimer, the term of this patent is extended or adjusted under 35 U.S.C. 154(b) by 229 days.

(21) Appl. No.: 11/066,132

(22) Filed: Feb. 24, 2005

(65) Prior Publication Data

US 2005/0183762 A1 Aug. 25, 2005

(30) Foreign Application Priority Data

Feb. 24, 2004 (CN) ..... 2004 2 0021402 U

(51) Int. Cl.
*A45B 17/00* (2006.01)
*A45B 25/14* (2006.01)

(52) U.S. Cl. ..... 135/21; 135/20.1; 135/98

(58) Field of Classification Search ..... 135/20.1, 135/20.3, 21, 16, 98, 25.4, 90; 242/394–395; 248/317, 218.4, 219.2, 283.1, 118.3; 473/483–484, 473/479

See application file for complete search history.

(56) References Cited

U.S. PATENT DOCUMENTS

| | | | |
|---|---|---|---|
| 2,235,518 | A | 3/1941 | Goshaw |
| 2,475,406 | A | 7/1949 | Russell |
| 2,661,752 | A | 12/1953 | Kampf et al. |
| 2,905,187 | A | 9/1959 | Croce |
| 3,120,238 | A | 2/1964 | Glatz |
| 3,145,720 | A | 8/1964 | Torii |
| 4,586,525 | A | 5/1986 | Glatz et al. |
| 4,622,987 | A | 11/1986 | Redl et al. |
| 4,674,523 | A | 6/1987 | Glatz |
| 4,697,606 | A | 10/1987 | Ma |
| 4,878,509 | A | 11/1989 | Tung |
| 5,002,081 | A | 3/1991 | Stromeyer |

(Continued)

FOREIGN PATENT DOCUMENTS

| | | | |
|---|---|---|---|
| CN | 2419864 | Y | 2/2001 |

(Continued)

OTHER PUBLICATIONS

Operation Manual Easy Sun Parasol Sunshade (Issue: 07.2004) pp. 1-17.

(Continued)

*Primary Examiner*—Winnie Yip
(74) *Attorney, Agent, or Firm*—Knobbe Martens Olson & Bear LLP

(57) ABSTRACT

An umbrella or sunshade is provided that includes a support pole assembly and a tilt assembly. The support pole assembly includes a first support pole and a second support pole. The second support pole has a proximal end and a distal end and is curved therebetween. The second support pole is coupled with and extends generally transverse to the first support pole. The tilt assembly includes a transmission and a drive shaft. The drive shaft is housed in the second support pole. The drive shaft has a first end coupled with the transmission and a second end adjacent to the distal end of the second support pole. The transmission is configured to convert rotation of a crank handle into rotation of the drive shaft to pivot a canopy coupled with the distal end of the second support pole relative to the first support pole.

22 Claims, 6 Drawing Sheets

U.S. PATENT DOCUMENTS

| | | | |
|---|---|---|---|
| 5,029,596 | A | 7/1991 | Tung |
| 5,156,395 | A | 10/1992 | Smith |
| 5,161,764 | A | 11/1992 | Roney |
| 5,349,975 | A | 9/1994 | Valdner |
| 5,499,644 | A | 3/1996 | Geniele |
| 5,584,564 | A | 12/1996 | Phyle |
| 5,611,364 | A | 3/1997 | Woods et al. |
| 5,678,585 | A | 10/1997 | May |
| 5,735,302 | A | 4/1998 | Saliva |
| 5,785,069 | A | 7/1998 | Glatz |
| D398,443 | S | 9/1998 | Bolle |
| 5,845,665 | A | 12/1998 | Koehn |
| 5,937,882 | A | 8/1999 | Harbaugh |
| 6,014,980 | A | 1/2000 | Glatz |
| D434,215 | S | 11/2000 | Lin |
| 6,152,156 | A | 11/2000 | Tung |
| D434,556 | S | 12/2000 | Lin |
| 6,220,261 | B1 | 4/2001 | Glatz |
| 6,311,705 | B1 | 11/2001 | Ma |
| 6,435,444 | B1 | 8/2002 | Lin |
| 6,478,037 | B2 | 11/2002 | Tung |
| 6,520,192 | B1 | 2/2003 | Lo |
| 6,575,182 | B2 | 6/2003 | Tung |
| 6,575,183 | B2 | 6/2003 | Tung |
| D477,458 | S | 7/2003 | Goldwitz |
| 6,588,438 | B1 | 7/2003 | Steiner |
| 6,619,306 | B2 | 9/2003 | Ma |
| 6,662,815 | B2 | 12/2003 | Tung |
| D497,479 | S | 10/2004 | Yu |
| 6,837,255 | B2 | 1/2005 | Bunch et al. |
| 6,840,253 | B2 | 1/2005 | Ma |
| 6,851,823 | B2 | 2/2005 | Bilotti |
| 6,923,193 | B2 | 8/2005 | Chen |
| 6,926,019 | B2 | 8/2005 | Glatz |
| 6,953,043 | B2 | 10/2005 | Yu |
| 6,988,504 | B1 | 1/2006 | Goldwitz |
| D518,629 | S | 4/2006 | Ma |
| 2002/0083969 | A1 | 7/2002 | Tung |
| 2002/0104557 | A1 | 8/2002 | Tung |
| 2003/0010366 | A1 | 1/2003 | Glatz |
| 2003/0015230 | A1 | 1/2003 | Glatz |
| 2004/0031513 | A1 | 2/2004 | Bunch et al. |
| 2004/0055627 | A1 | 3/2004 | P. Moga |
| 2004/0055628 | A1 | 3/2004 | Yu |
| 2004/0069333 | A1 | 4/2004 | Ma |
| 2004/0182429 | A1 | 9/2004 | Chen |
| 2005/0229957 | A1 | 10/2005 | Glatz |
| 2005/0268952 | A1 | 12/2005 | Joen-an Ma |
| 2006/0278262 | A1 | 12/2006 | Ma |

FOREIGN PATENT DOCUMENTS

| | | |
|---|---|---|
| DE | 580503 | 7/1933 |
| DE | 32 29 776 | 4/1983 |
| DE | 3229776 | 4/1983 |
| DE | 3820573 A1 | 8/1989 |
| DE | 202 05 561 U1 | 7/2002 |
| EP | 0 392 989 | 10/1990 |
| EP | 1 400 186 | 3/2004 |
| GB | 22218 | 0/1911 |
| WO | WO 97/04682 | 2/1997 |
| WO | WO 00/55456 | 9/2000 |
| WO | WO 2005/018369 A1 | 3/2005 |

OTHER PUBLICATIONS

Page 2 of Treasure Garden, Inc's product brochure identified as "AG3 9' Centilever Umbrella."

U.S. Appl. No. 11/134,074, filed May 22, 2005, Ma.

U.S. Appl. No. 11/211,127, filed Aug. 24, 2005, Ma.

U.S. Appl. No. 11/324,952, filed Jan. 4, 2006, Ma.

European Patent Application No. 05255414.4 Search Report dated Jun. 6, 2006.

2006-0201542 (U.S. Appl. No. 11/211,127) and its prosecution history including the Office Action mailed Aug. 20, 2007.

2006-0278262 (U.S. Appl. No. 11/324,952) and its prosecution history including the Office Action mailed Jul. 1, 2008.

2006-0201542 (U.S. Appl. No. 11/211,127) and its prosecution history including the Office Action mailed Mar. 20, 2008.

The Office Action dated Jan. 27, 2009 issued in Co-Pending U.S. Appl. No. 11/324,952.

UMBRELLA ASSEMBLY WITH TILT ADJUSTMENT

RELATED APPLICATIONS

This application claims priority under 35 U.S.C. §119 (a) to Chinese Utility Model No. 200420020402.X, filed Feb. 24, 2004.

BACKGROUND OF THE INVENTION

1. Field of the Invention

The invention relates to the field of umbrella/parasol devices and more particularly to an umbrella/parasol with an adjustable tilt feature.

2. Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly which is frequently generally circular and which includes a plurality of support ribs. The support ribs can be deployed and supported in position to uphold a fabric canopy which provides shade and protection from the elements. The canopy assembly is generally supported above users of the umbrella or parasol, generally either by support structures which extend underneath the canopy assembly, or by support structures which extend upward along an outer periphery of the canopy assembly and further extend toward the center of the canopy assembly to support the same in a suspended manner.

One consideration in the use and design of umbrellas or parasols is that the incident sunlight and environmental elements which the users may wish to be shielded against, for example rain which may be wind-driven, is subject to change. As another example, the incident angle of sunlight changes throughout the course of a day as the sun traverses across its daily path. Similarly, the direction of wind during inclement weather may change, such that the rainfall direction, while generally downwards, may shift direction of horizontal components of its fall. Thus, in many applications, it is a desirable feature that an umbrella or parasol assembly be provided with some sort of adjustment or variable positioning to accommodate such shifts in the relative angle of protection provided.

For example, U.S. Pat. No. 5,937,882 to Harbaugh discloses an umbrella with side support for tilting an opening or a generally vertically extending support structure which is interconnected via movable interconnecting braces to a canopy assembly, such that the canopy assembly can be tilted outward and inward with respect to the vertical support at a variety of tilt angles from a generally vertically erect orientation. However, the Harbaugh device is capable of tilting in only a single direction away from a vertically erect orientation, and this direction is generally away from the vertical support. This presents disadvantageous limitations to use of the Harbaugh umbrella as the Harbaugh umbrella is not capable of tilting towards the vertical support to provide protection to a user should the incident angle of sunlight or other environmental elements indicate such a positioning of the canopy assembly. Even if the Harbaugh reference were somehow modified to provide such an adjustment capability, a sheltered or shielded zone provided by the canopy assembly would coincide with the vertical support, thereby blocking or obstructing that area underneath the Harbaugh umbrella, for example, for placement of chairs, tables, or the users themselves.

U.S. Pat. Nos. 4,878,509 and 5,029,596 to Tung disclose a stepless tilting device for umbrellas of the general type wherein the canopy assembly is supported underneath by a generally vertically-extending support member, however, with the support member provided with a mechanism for stepless tilting of the umbrella from a generally vertically erect orientation. However, similar to the Harbaugh device, the Tung devices provide tilting in only a single direction from the vertical erect orientation and further suffer the drawback of this general type of umbrella or parasol that the generally vertically extending support member positioned underneath the canopy assembly partially blocks the shielded or sheltered region provided underneath the canopy assembly, thereby limiting the placement of tables, chairs, and users.

U.S. Pat. Nos. 6,152,156 and 6,478,037 also to Tung disclose another variation of a sunshade with tiltable canopy, wherein a canopy assembly is suspended from above by an arcuate tube which is hingedly connected to a generally vertically extending support pole. Thus, via adjustment of the hinged interconnection between the arcuate tube and the vertical support pole, the canopy assembly of the Tung '156 and '037 devices can be tilted inwards and outwards from a generally vertically extending orientation, however, again suffer similar disadvantages to the Harbaugh device as they appear to only offer a tilt in a single direction away from the generally vertical support pole. Also, if somehow modified to provide tilt towards the pole, these Tung devices would again suffer from blockage of the shielded or sheltered region underneath the canopy assembly by the presence of the vertical support pole.

U.S. Pat. No. 6,662,815 also to Tung discloses a canopy support frame for a sunshade which is similar in many respects to the '156 and '037 devices, however, with the further addition of a toothed joint which is configured to be held together in tension as the canopy assembly is erected by a cable member, such that throughout various tilt angles of the arcuate tube with respect to the vertical support, the canopy assembly is maintained in a substantially vertically erect orientation in spite of variations in the relative angle between the arcuate tube and the vertical support and also in applications wherein the vertical support is not oriented in a vertical orientation.

SUMMARY OF THE INVENTION

Thus, it will be appreciated that there is an unsatisfied need for an umbrella or parasol assembly which provides greater flexibility in tilting adjustment and more particularly avoids interference of the shielded or sheltered region provided underneath the canopy throughout the range of tilt adjustment with, for example, support structure of the umbrella assembly itself to provide greater access and utility to users, for example, for placement of furniture. It would be a further advantage to provide such an umbrella or parasol assembly configured for improved ease of use, for example, by avoiding the need for tools, excessive force, or two handed operation to provide the desired tilting adjustment. It would also be advantageous that such an umbrella or parasol assembly having tilt capability be of robust and relatively simple construction and with reduced exposure of operating or moving parts to the environment to reduce exposure to dirt, dust, grit, water, or other contaminants.

In one embodiment, an umbrella assembly is provided. The umbrella assembly includes a support pole assembly, a canopy assembly, and a tilt assembly. The support pole assembly includes a first, generally vertically extending support pole and a second support pole. The second support pole has a proximal end and a distal end and is curved therebetween. The second support pole is coupled with and extends generally transverse to the first support pole. The canopy assembly is coupled with the second support pole adjacent the distal end. The tilt assembly includes a transmission and a drive shaft. The transmission is configured to be driven by a crank handle. The drive shaft is housed in the second support pole. The drive shaft has a first end coupled with the transmission and a second end adjacent to the distal end of the second support pole. The transmission is configured to convert rotation of the crank handle into rotation of the drive shaft to pivot the canopy assembly relative to the first support pole.

In another embodiment, a sunshade is provided that includes a support pole assembly, a canopy assembly, a linkage, and a crank member. The support pole assembly includes a supporting pole having a lower end and an upper end, a holding sleeve pivotally connected to the upper end of the supporting pole, and a suspending tube slidably extended through the holding sleeve. The suspending tube includes a first end and a second end. The canopy assembly is coupled with the second end of the suspending tube for suspending a canopy. The canopy assembly also includes an upper central member having a plurality of ribs attached thereto for supporting a canopy, and a lower central member having a plurality of struts attached thereto for supporting the ribs. The linkage extends between the first end and the second end of and within the supporting tube. The crank member coupled with the support pole assembly. In this embodiment, the linkage is configured to be rotated when the crank member is rotated, whereby the canopy assembly is tilted relative to the support pole.

In another embodiment, an umbrella assembly is provided that includes a support pole assembly, a canopy assembly, and a tilt assembly. The support pole assembly includes a first, generally vertically extending support pole and a second support pole. The second support pole has a proximal end and a distal end and defines a first length therebetween. The second support pole is coupled with and extends generally transverse to the first support pole. The canopy assembly is coupled with the second support pole adjacent the distal end thereof. The tilt assembly includes a transmission configured to be driven by a crank handle and a drive shaft. The drive shaft has a first end and a second end and defines a second length therebetween. The first end of the drive shaft assembly is coupled with the transmission. The first length is not substantially less than the second length. Rotation of the drive shaft assembly pivots the canopy assembly relative to the first support pole.

In another embodiment, an umbrella assembly includes an extendable canopy assembly, a generally vertically extending support structure, and a generally horizontally extending interconnecting structure. The generally horizontal structure interconnects the canopy assembly and the vertically extending support structure so as to suspend the canopy assembly and such that the canopy assembly can be oriented both inwards and outwards with respect to the vertically extending structure as well as tilted side to side.

In another embodiment is a tilt system for an umbrella assembly, the tilt system comprising a transmission assembly having an input and an output, a crank handle connectable to the input of the transmission assembly, a drive shaft assembly configured to be operated within an arcuate support pole, the drive shaft assembly defining a drive shaft axis and being connected at a first end to the output of the transmission assembly, and a tilt mechanism connected to a second end of the drive shaft assembly such that user actuation of the crank handle induces the tilt assembly to pivot about an axis generally parallel with the drive shaft axis to a tilt orientation.

Various additional features, objects, and advantages of the invention will be more apparent from the following description taken in conjunction with the accompanying drawings.

DETAILED DESCRIPTION OF THE PREFERRED EMBODIMENTS

Figure 1:
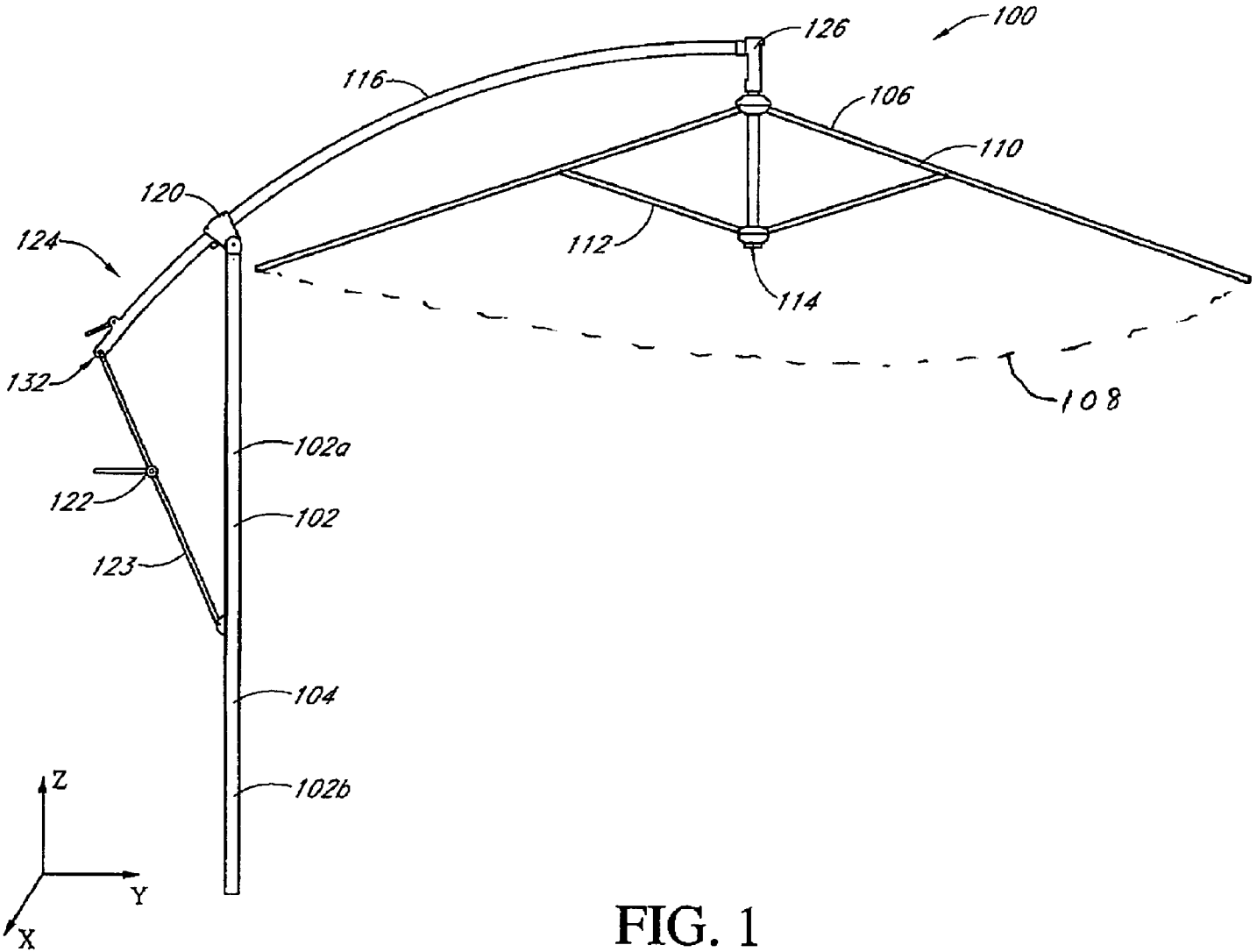
FIG. 1 is a side view of one embodiment of an umbrella assembly with tilt adjustment in a first inward/outward tilt orientation.

Reference will now be made to the drawings wherein like reference numerals refer to like parts throughout. The figures also illustrate embodiments of the invention with respect to an indicated 3-dimensional Cartesian space. It will be appreciated that description of the various embodiments with respect to this Cartesian space is for the reader's ease of understanding the relative orientations and interactions of components of the various embodiments, and should not be interpreted as limiting on the implementation or use of the described and claimed embodiments. For example, where reference is made to a vertical orientation, e.g., generally along the indicated Z axis, this is for the reader's clarity of understanding with reference to the indicated components and does not limit the indicated components to use or construction in a vertical orientation.

FIG. 1 is a side view of one embodiment of an umbrella assembly with tilt adjustment 100 which is adapted to providing flexible shade and protection from the elements, particularly in outdoor settings, such as in patios, outside balconies, gardens, cafes, sports facilities, and the like. In this embodiment, the umbrella assembly 100 includes a vertical support 102 which in certain embodiments comprises a single elongate member and in yet other embodiments, comprises multiple vertical support members indicated as members 102*a* and 102*b* which may be joined by a telescope joint 104. Thus, depending upon the requirements of a particular application, various embodiments of the vertical support 102 can be embodied in a telescoping, height adjustable manner and in other embodiments provided as a single unitary piece configured for the requirements of a given application. The vertical support 102 may be further provided with attachment or fitment structures at a lower end thereof, for example, for placement in the ground or paving structures, as well as attachment or interconnection to a base member.

The umbrella assembly 100 also comprises in this embodiment a canopy assembly 106 which includes a plurality of canopy webs 110 which are interconnected to an erector base 114 via a corresponding plurality of support struts 112 which are hingedly or pivotably interconnected with the canopy webs 110 and the erector base 114. This allows the canopy assembly 106 to transition between an open or erect configuration as illustrated in FIG. 1 and a folded or stowed configuration wherein the canopy assembly is lowered, for example, for stowage or movement of the umbrella assembly 100. The canopy assembly 106 would typically be covered with and support a canopy 108 of suitable material, e.g. fabric or plastic, providing the shade and weather protection functions of the umbrella assembly. The canopy 108 is shown in ghost lines for ease of viewing the underlying structure.

In this embodiment, the canopy assembly 106 is interconnected with the vertical support 102 via an interposed interconnecting member 116. The interconnecting member 116 is a relatively rigid elongate member and in certain embodiments is arched or arcuate in configuration. The interconnecting member 116 extends generally horizontally from the vertical support 102 across the top or upper surface of the canopy assembly 106 and attaches to and supports the canopy assembly 106 in a suspending manner. As previously noted, this general arrangement of support and attachment to the canopy assembly 106 provides the advantage that the region or sheltered area underneath the canopy assembly 106 is not obstructed by underlying support structure as in other types of umbrella or parasol assemblies.

Figure 9:
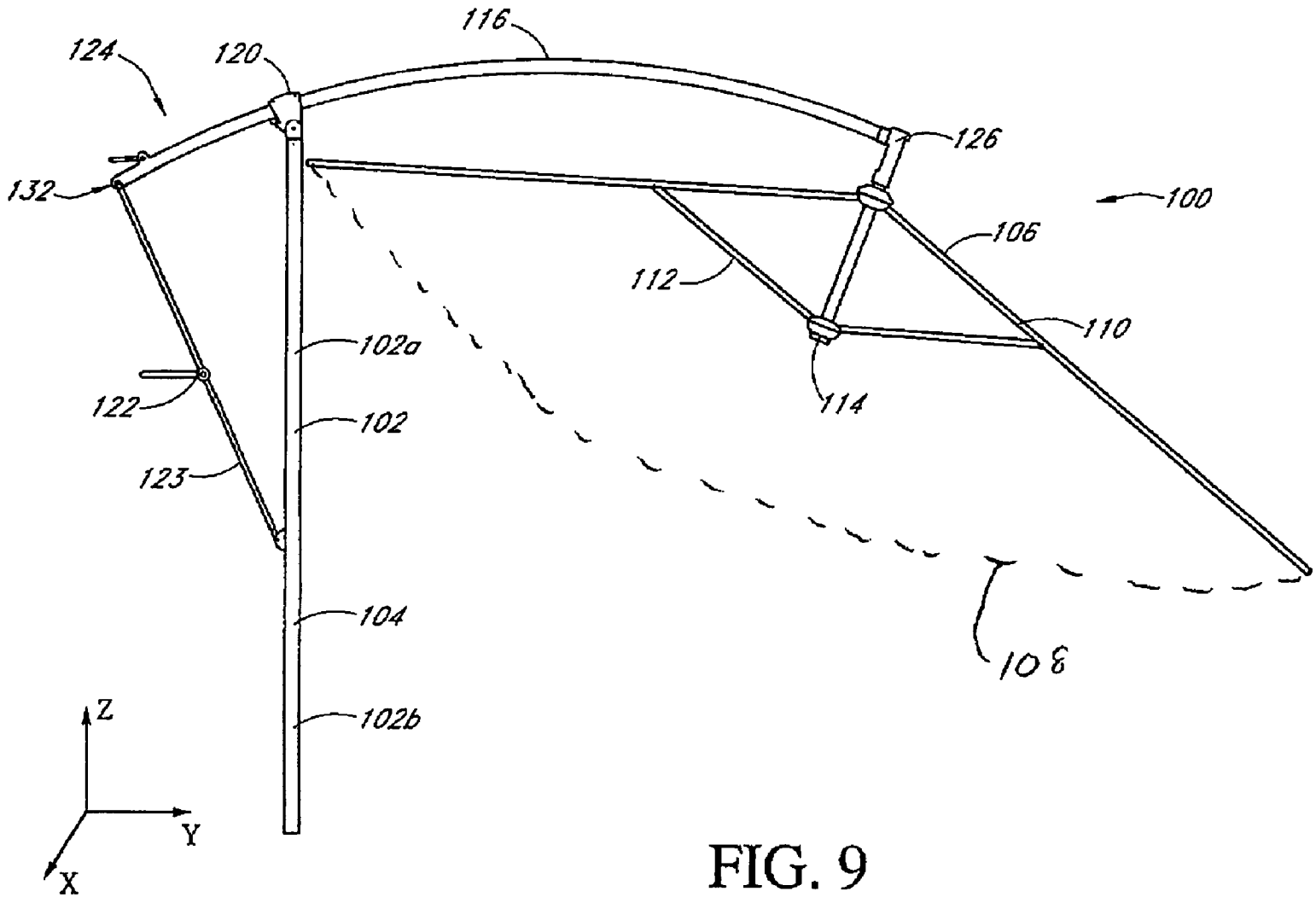
FIG. 9 is a side view of one embodiment of an umbrella assembly with tilt adjustment in a second inward/outward tilt orientation.

In this particular embodiment, the interconnecting member 116 is connected to the vertical support 102 via an interposed coupler 120. The coupler 120 of this embodiment is slidingly engaged with the interconnecting member 116 such that when the coupler 120 is loosened, the interconnecting member 116 can slide axially within the coupler 120, e.g., generally in the YZ plane to vary and adjust the extension of the interconnecting member 116 from the upper end of the vertical support 102. In this embodiment, the coupler 120 is provided with fasteners, clamps, tighteners, or the like to secure the interconnecting member 116 in a desired axial location. The coupler 120 is also configured in this embodiment for hinged connection to the upper end or top end of the vertical support 102 such that the interconnecting member 116 and attached canopy assembly 106 can be pivoted or tilted generally about the X axis or in the YZ plane, for example, between a first inward/outward tilt orientation, as shown in FIG. 1, to a second inward/outward tilt orientation, such as shown in FIG. 9. In this embodiment, the coupler 120 is also provided with a fastener, clamp, or the like to fix the interconnecting member 116 to a desired inward outward tilt orientation with respect to the vertical support 102.

In this embodiment, the umbrella assembly 100 further comprises an erector mechanism 122 which is configured generally as a crank member configured for hand operation by the user. In one embodiment, the crank member is coupled with a tension cable, cord, rope, chain, or the like and with the erector base 114. In one embodiment, the tension cable, cord, rope, chain, or the like extends at least partially through or within the vertical support or the interconnecting member 116. For example, the interconnecting member can be configured such that a passage 125 through which the tension cable, cord, rope, chain, or the like may extend is provided. The passage 125 may be defined adjacent to or alongside other components, such as a drive shaft assembly, discussed below. In one embodiment, the passage 125 includes a first short passage 125*a* extending distally of the proximal end of the interconnecting member 116 and a second short passage 125*b* extending proximally of the distal end of the interconnecting member 116. The passage 125 can be formed a plurality of segments, some of which are about the same size as the tension cable, cord, rope, chain, or the like. In one embodiment, the drive shaft assembly and the tension cable, cord, rope, chain, or the like extend alongside each other in a common lumen of the interconnecting member 116.

Actuation of the erector mechanism 122 applies tension force to the cord, rope, chain, cable, or the like so as to draw the erector base 114 upwards, thereby extending or erecting the support struts 112 and interconnected canopy webs 110. Similarly, reverse actuation of the erector mechanism 122 allows the canopy assembly 106 to collapse or fold as tension is released from the erector base 114. The umbrella assembly 100 can be arranged so that when the canopy assembly 106 is closed, the umbrella assembly 100 is relatively compact. For example, the interconnecting member 116 can be retracted proximally in the coupler 120 until the proximal end of the interconnecting member 116 is adjacent a lower end of the vertical support 102 and a distal end of the interconnecting member 116 is adjacent to an upper end of the vertical support 102. In this position, the canopy assembly 106, the vertical support 102, and the interconnecting member 106 would all be position very closely together. Some additional conventional features useful in opening and closing an umbrella assembly are set forth in U.S. Pat. No. 6,152,156, which is hereby incorporated by reference herein in its entirety. In one embodiment, the erector mechanism 122 is incorporated with a brace member 123 which offers a triangulated bracing between the vertical support 102 and the interconnecting member 116. It will be appreciated that in certain embodiments, the brace member 123 is of fixed length and in slidable engagement with the vertical support 102. In other embodiments, the brace member 123 is of telescoping or adjustable length to accommodate the embodiments of the umbrella assembly 100 wherein hinging and relative axial movement of the interconnecting member 116 is provided with the coupler 120.

Figure 3:
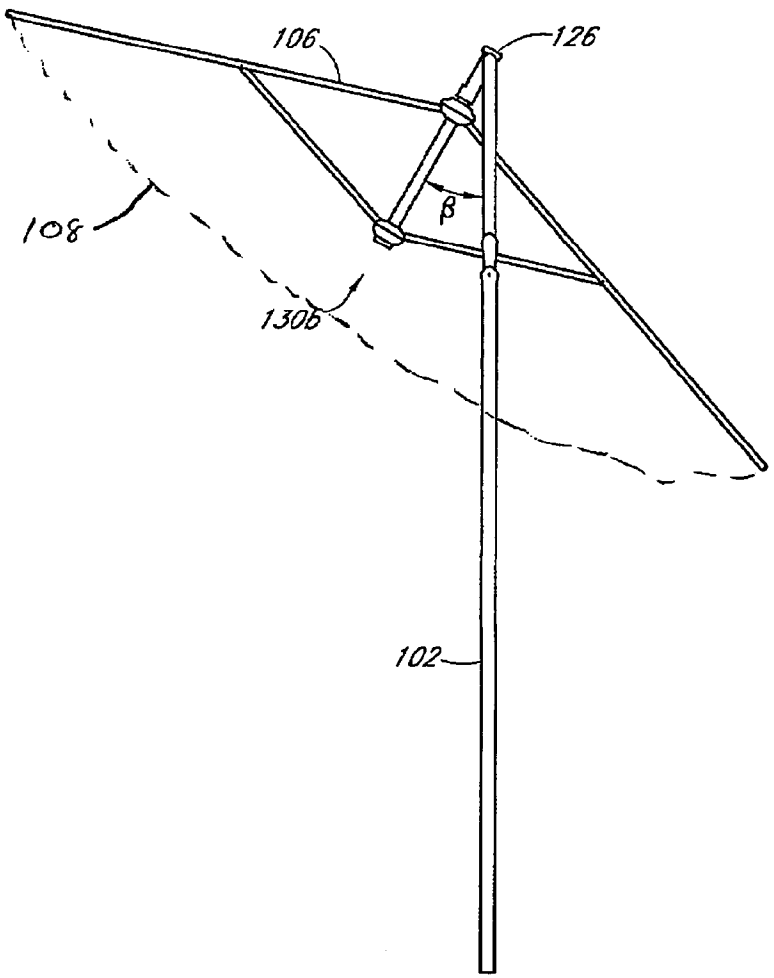
FIG. 3 is a rear view of one embodiment of an umbrella assembly with tilt adjustment in a second tilt orientation.
Figure 2:
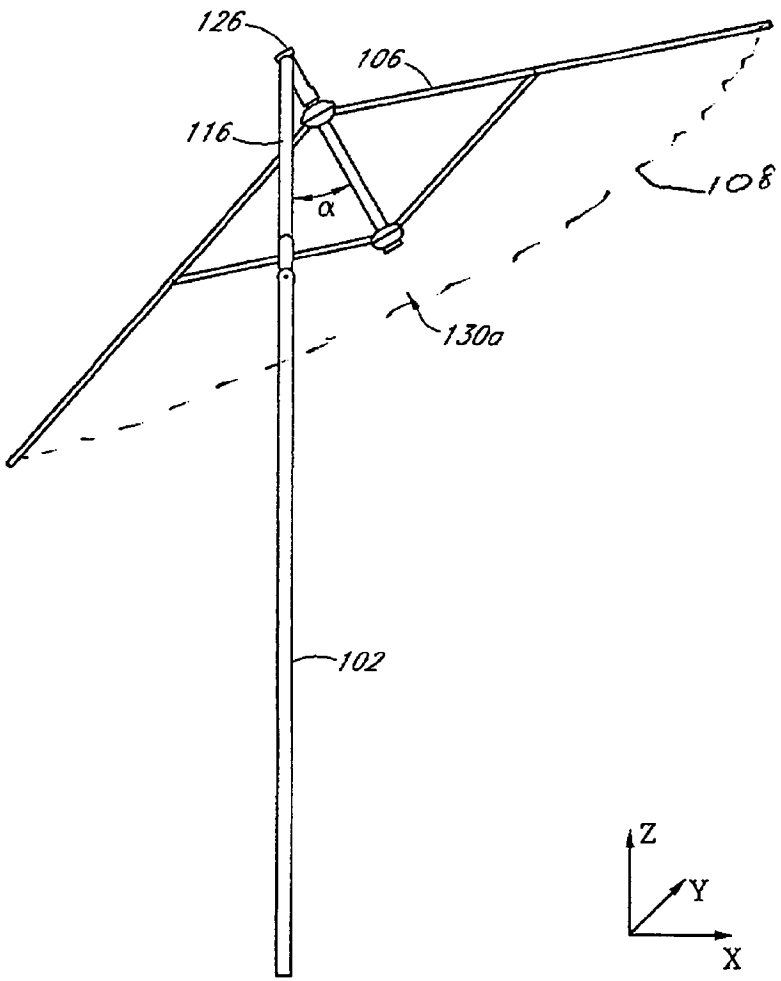
FIG. 2 is a rear view of one embodiment of an umbrella assembly with tilt adjustment in a first tilt orientation.

In this embodiment, the umbrella assembly 100 also comprises a tilt drive 124 and a tilt assembly 126 which together provide a tilt system 132 for the umbrella assembly 100. More particularly, the tilt drive 124 in this embodiment is arranged at a first end of the interconnecting member 116 that is opposite a second end of the interconnecting member 116 which is adjacent the canopy assembly 106. The tilt drive 124 is configured for user actuation without requirement for special tools or application of excessive actuation force. The tilt assembly 126 is arranged at a distal end of the interconnecting member 116 or adjacent the canopy assembly 106. Together, the tilt system 132 provides the capability to the umbrella assembly 100 that user actuation of the tilt drive 124 induces the tilt assembly 126 and corresponding canopy assembly 106 to tilt or adjust, for example, between a first tilt orientation 130*a*, which is displaced an angle $\alpha$ from a vertical orientation, as illustrated in FIG. 2, and a second tilt orientation 130*b*, which is displaced in angle $\beta$ from a vertical orientation toward the left, as illustrated in FIG. 3.

The tilt system 132 is further configured such that the relative tilt orientation 130 of the canopy assembly 106 can be readily adjusted by the user via application of force to the tilt drive 124. Preferably, when the actuating force is removed, the tilt system 132 of the umbrella assembly 100 resists restoring forces which may impinge upon the canopy assembly 106, such as via wind loading, rainfall, gravitational forces. As such, the umbrella assembly 100 resists variation in a set tilt orientation 130 absent further user actuation of the tilt drive 124. Thus, the umbrella assembly 100 provides the capability to a user to readily adjust the tilt drive 124 and once the desired tilt orientation 130 is achieved, the user can simply step away from the umbrella assembly 100 and the canopy assembly 106 will be maintained in substantially the set tilt orientation 130. Preferably the user is not required to further secure the canopy assembly 106 in place, such as via application of clamping or tightening forces or utilization of fasteners, detents, latches, and the like.

Figure 4:
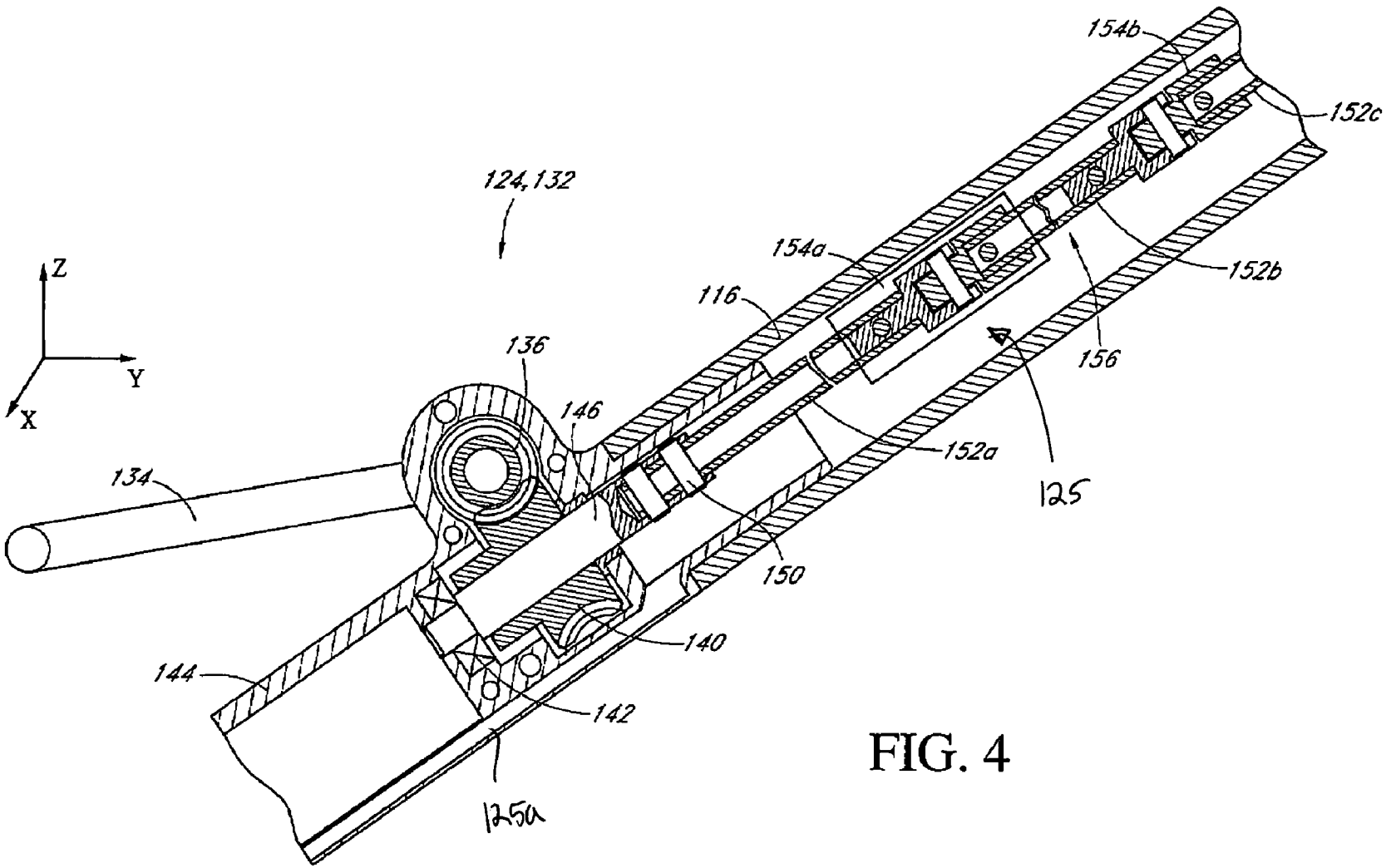
FIG. 4 is a side section view of a portion of one embodiment of a tilt system for an umbrella.

FIG. 4 illustrates in greater detail embodiments of the tilt drive 124 of the tilt system 132. In this embodiment, the tilt drive 124 includes a user adjustment member 134 which can be configured as a hand operable crank via which a user can apply operational force to the tilt drive 124. The user adjustment member 134 is engaged with a transmission 136 such that user force provided to the user adjustment member 134 is converted into actuating force to induce the tilt assembly 126 to vary the tilt orientation 130 of the canopy assembly 106. In one embodiment, the transmission 136 includes a gear wheel 140, e.g. comprising a U-shaped spiral thread engaged with corresponding threads of the user adjustment member 134, such that together the user adjustment member 134 and gear wheel 140 define a worm gear assembly. In yet other embodiments, the transmission 136 provides hypoid gear arrangements, belt and pulley arrangements, sprocket and chain arrangements, or the like, such that the user provided force at the user adjustment member 134 is converted to the required operating force to induce the tilt assembly 126 to pivot.

In one embodiment, an outer cover 144 is provided and is interconnected to the first end of the interconnecting member 116. In this embodiment, the gear wheel 140 is connected to the outer cover 144 via a bearing 142 and the transmission 136 also is mounted within the outer cover 144. The user adjustment member 134 engages with the transmission 136, such that together the outer cover 144 substantially encloses and protects one or more of the operating moving parts of the tilt drive 124. Such protection is against contamination with dirt, debris, dust, and the like which may degrade or shorten the life of the tilt drive 124, as well as against possible injury to a user who could become entrapped within moving parts of the tilt drive 124. Thus, the enclosure provided by the outer cover 144 increases durability, longevity, and safety for the tilt drive 124. Further, the outer cover 144 can be configured in an aesthetically pleasing form such that the possibly aesthetically less pleasant operating components of the tilt drive 124 are shielded from user view.

In this embodiment, the gear wheel 140 is also engaged with an output shaft 146. The output shaft 146 provides an output from the tilt drive 124 wherein the user adjustment member 134 provides a corresponding input. Thus, in this embodiment, the user adjustment member 134 operates substantially about an input axis that lies generally along or parallel to the X axis and converts this input force via the transmission 136 into a corresponding rotation arranged generally 90 degrees relative to the input axis of the user adjustment member 134, e.g., substantially within the YZ plane. The output shaft 146 is engaged via shaft rings 150 with a proximate drive shaft member 152*a*. The drive shaft member 152*a* is a generally rigid straight elongate member which is interconnected with the output shaft 146 such that rotation of the output shaft 146 is correspondingly conveyed to the drive shaft member 152*a*. In this particular embodiment, the proximate drive shaft member 152*a* is a first drive shaft member that is coupled via a first joint 154*a* to a second drive shaft member 152*b*. The second drive shaft member 152*b* is further coupled via a second joint 154*b* to a third drive shaft member 152*c*.

As illustrated in FIG. 1, in certain embodiments, the interconnecting member 116 is arched or arcuate or otherwise extends along a non-linear path between the tilt drive 124 and the tilt assembly 126. Thus, in certain embodiments, a plurality of drive shaft members 152 interconnected via interposed joints 154 provides an articulated flexible drive shaft assembly such that the rotational output of the transmission 136 can be conveyed along this curved or non-linear path to the tilt assembly 126. The number of drive shaft members 152 and corresponding joints 154 is determined, in certain embodiments, both by the physical dimensions of the particular embodiment of umbrella assembly 100 (e.g. the length of the interconnecting member 116). The number and characteristics of drive shaft members 152 and corresponding joints 154 is determined in some embodiments by the required forces needed to implement the described tilt capability of the umbrella assembly 100 described above.

The degree of curvature, if present, of the interconnecting member 116 can influence an appropriate length dimension for each individual drive shaft member 152. It will be appreciated that in some embodiments, the interconnecting member 116 is substantially straight such that a single drive shaft member 152 can provide the needed transmission of force. In other variations, only a portion of the interconnecting member 116 is curved or arcuate, such that different lengths of drive shaft members 154 are appropriate for particular applications. It will be further understood that depending upon the physical dimensions and inertial loading of an umbrella assembly 100, an arched or arcuate interconnecting member 116 can be accommodated by a drive shaft assembly 156 which is of a single unitary construction, however, comprises inherent flexibility. For example, relatively small lightweight umbrella assemblies 100 can accommodate carbon fiber, fiberglass, and/or plastic drive shaft assemblies 156 where the force transmission required is relatively low.

Figure 5:
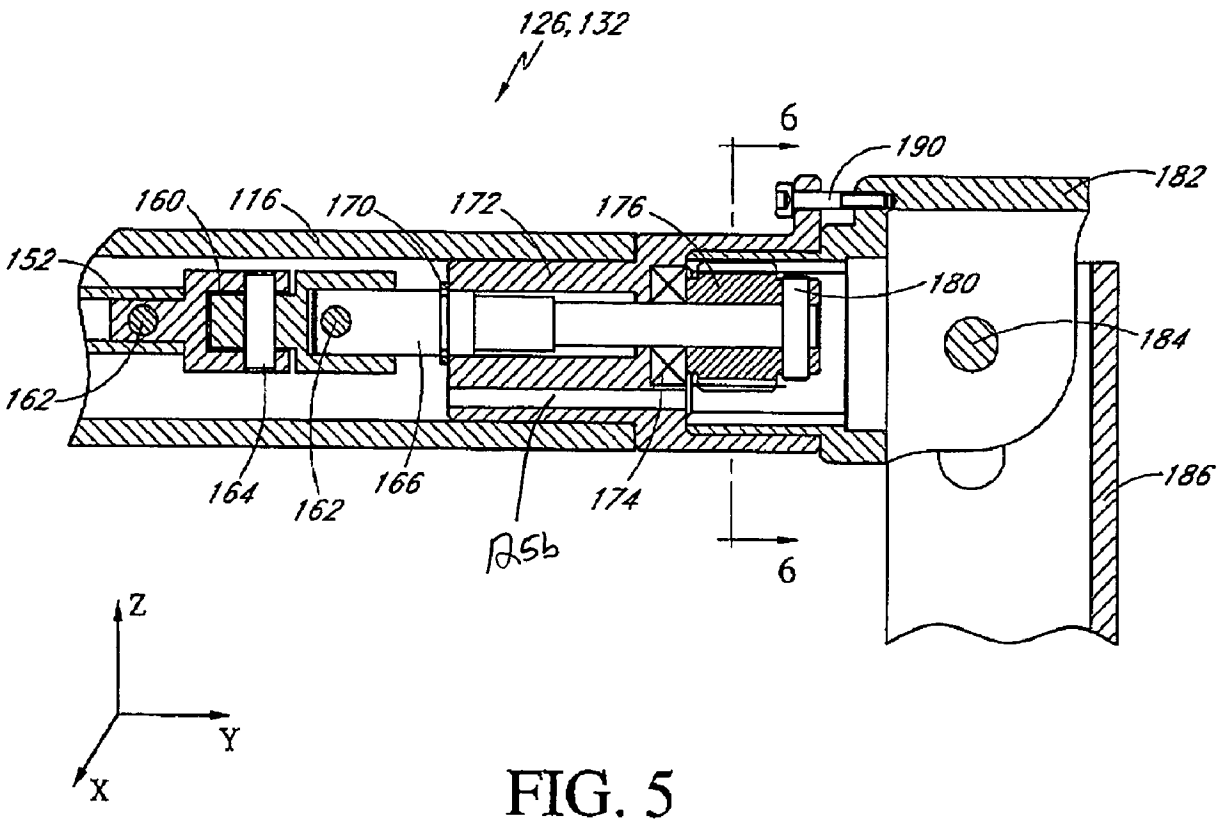
FIG. 5 is a side section view of another portion of one embodiment of a tilt system for an umbrella.

FIG. 5 illustrates one embodiment of a tilt assembly 126 for a tilt system 132. In this embodiment, a distal end of the interconnecting member 116 is attached to a housing 172 adjacent the attachment of the tilt assembly 126 to the canopy assembly 106. In this embodiment, a last drive shaft member 152 is terminated with a corresponding connecting head 160 and secured via a fastener 162, such as a screw, clinch, weld, adhesive joint, rivet, or the like. The last drive shaft member 152 is further coupled to a shaft 166 which is also provided with a corresponding fastening head 160 which is connected to the shaft 166 by a further fastener 162. The last drive shaft member 152 and shaft 166 are further coupled by an interposed coupling ring 164 such that rotational movement of the last drive shaft member 152 is transferred to the shaft 166, but a limited degree of flexibility or articulation is provided via the connecting heads 160 and coupling ring 164 so as to provide a limited universal joint-type movement. The shaft 160 is retained within the housing 172 via a retainer 170 such that the shaft 166 is free to rotate within the housing 172 but restrained against axial movement with respect thereto. The shaft 166 is further supported by a bearing 174 and terminated with a drive member 176 which is held by a further retainer 180 which may further comprise bearing functionality. The drive member 176 is affixed to the shaft 166 such that rotation of the last drive shaft member 152, such as arising from the interconnection to the tilt drive 124, is conveyed to the drive member 176.

The drive member 176 can be engaged with inner surfaces of an upper hinge 182 which is engaged with the housing 172 in such a manner as to be free to rotate with respect to the housing 172. In one embodiment, the rotation is generally about the Y axis, but is restrained against axial translation with respect thereto. In one embodiment, axial restraint is provided by a cooperating flange or abutment portion of the upper hinge 182 which can engage a respective flange or abutment portion of the housing 172. Further axial restraint can be provided by one or more retention members 190.

Figure 6:
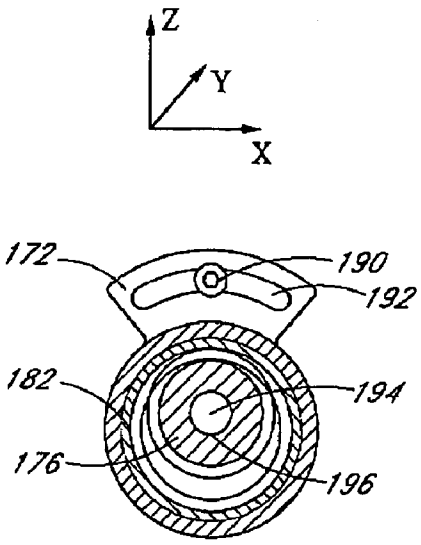
FIG. 6 is an end section view along indicated lines A-A of the embodiment illustrated in FIG. 5.

FIG. 6 illustrates one embodiment of the internal arrangement of the tilt assembly 126 in an end section view. In this embodiment, the drive member 176 is nested within and engages with inner surfaces of the upper hinge 182. The drive member 176 is further of smaller dimensions and offset with respect to a centerline of the upper hinge 182, such that a drive shaft axis 194 about which the drive member 176 can be induced to rotate is substantially parallel with and offset from a tilt axis 196 defining an axis of rotation of the upper hinge 182. The housing 172 is fixed to the distal end of the interconnecting member 116 in one embodiment. The upper hinge 182 is free to rotate with respect to the housing 172 with respect to the interconnecting member 116 in one embodiment. Thus, as the drive member 176 is induced to rotate about the drive shaft axis 194, the rotation of the drive member 176 induces the upper hinge 182 into a corresponding rotation. In certain embodiments, the allowable rotation of the upper hinge 182 in a side-to-side manner (about the Y-axis shown in FIG. 6) is partially restricted via a slot (which may be arcuate) formed in an extension of the housing 172 through which the retention member 190 passes and is engaged to the upper hinge 182. The freedom of movement of the upper hinge 182 in a rotational aspect about the Y axis can in this manner be limited by the dimensions of the arcuate slot 192. In further embodiments, a set tilt orientation 130 may be maintained via securement of the retention member 190. Thus, the retention member 190 may be partially loosened to allow the tilt orientation 130 to be varied. Once a desired tilt orientation 130 is obtained, the retention member 190 can be retightened to further inhibit variation of the desired tilt orientation 130.

In various embodiments, the dirve member 176 engages with the inner surfaces of the upper hinge 182 in a geared manner. In yet other embodiments, one or more of outer surfaces of the drive member 176 and inner surfaces of the upper hinge 182 are provided with a resilient relatively high friction coefficient material, such as a synthetic rubber. Thus, depending upon the requirements of a particular application, embodiments of engagement between the drive member 176 and upper hinge 182 may be in a strictly mechanical implementation such that relative slippage between the drive member 176 and upper hinge 182 cannot occur without distortion or damage to one or both members. In other embodiments, the relative slippage between the drive member 176 and upper hinge 182 is inhibited yet accommodated upon application of sufficient force, for example, to inhibit damage to the umbrella assembly 100 upon accidental application of excessive force due, for example, to extreme wind loading or impact of an object upon the umbrella assembly 100.

In some embodiments, a lower hinge 186 is included that is engaged via a pivot 184 with the upper hinge 182. A lower or distal end of the lower hinge 186 is configured for attachment to the canopy assembly 106 and the pivoting engagement between the upper and lower hinges 182, 186 provides further adjustment possibilities for the tilt orientation 130 in an inward or outward direction with respect to the vertical support 102, e.g., a folding capability such that the canopy assembly 106 can be collapsed or closed and folded into adjacency with the interconnecting member 116 for storage or movement of the umbrella assembly 100. In one embodiments, the pivot 184 can include a tightening or fixing capability, such that upon attainment of a desired tilt orientation substantially about the X axis, the pivot 184 may be tightened to retain the umbrella assembly 100 in the desired configuration, and in yet other embodiments, the upper hinge 182 may be fixedly attached to the lower hinge 186, e.g., without the pivot 184.

Figure 8:
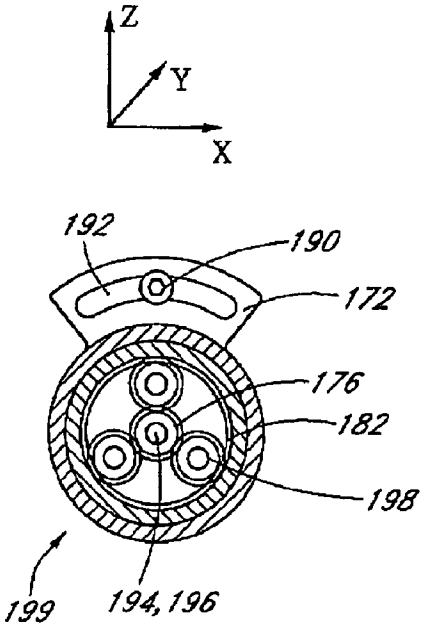
FIG. 8 is an end section view along indicated lines B-B of the embodiment illustrated in FIG. 7.
Figure 7:
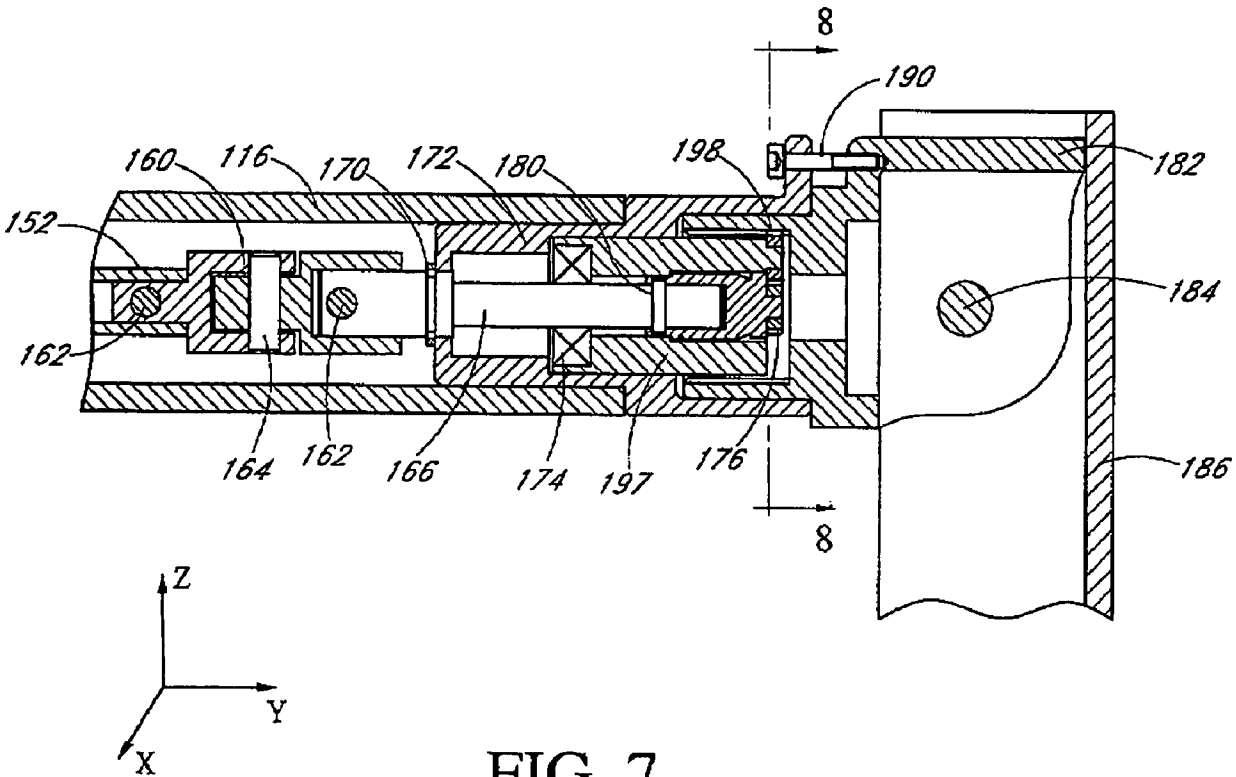
FIG. 7 is a side section view of another portion of another embodiment of a tilt system for an umbrella.

FIGS. 7 and 8 illustrate another embodiment of a tilt assembly 126 which is similar in certain respects to the previously described embodiments of tilt assembly 126 as illustrated in FIGS. 5 and 6, and detailed description of similar structures and components will not be repeated for brevity and ease of understanding. In this embodiment, the drive member 176 is affixed to the shaft 166 and retained by a retainer 180. The shaft 166 and drive member 176 are also positioned within a shaft cover 197 and are further engaged with one or more planetary wheels 198. In this particular embodiment, three planetary wheels 198 are fitted and interposed between the drive member 176 and inner surfaces of the upper hinge 182 so as to together define a planetary gear train 199. In one arrangement, a small passage similar to the passage 125*b* is provided for a cord or similar structure to pass through or alongside the planetary gear train 199. For example, a passage could be provided through the drive member 176, aligned with the axis 194.

One advantageous feature of the tilt system 132 including the tilt assemblies 126, such as illustrated in FIGS. 5 and 6, as well as in 7 and 8, are that the tilt systems 132 provide a mechanical reduction feature between the movement of the user adjustment member 134 and the corresponding rotational movement of the upper hinge 182 of the tilt assembly 126. This provides the advantage of mechanical advantage to a user such that relatively low user actuation forces are mechanically multiplied to provide corresponding greater actuation force at the tilt assembly 126 to allow a user to manipulate and orient a relatively large and high inertia canopy assembly 106 which may be further subject to wind and rain loading without excessive force required. A further advantage provided by the mechanical reduction of the tilt system 132 is that once the desired orientation 130 is obtained, the mechanical reduction of the tilt system 132 inhibits variation from this set tilt orientation 130 absent restoring user actuation force provided to the user adjustment member 134. Thus, the tilt system 132 provides a self-retaining capability to allow a user to manipulate the tilt orientation 130 of the canopy assembly 106 with a one handed operation and does not require the use of further clamping or fixing devices, for example, in a two handed operating mode which provides further ease of use and convenience to a user of the umbrella assembly 100.

Further advantages of the tilt system 132 as disclosed herein are that the mechanical operating portions of the tilt system 132 are substantially enclosed within the outer cover 144, the interconnecting member 116, and housing 172. Thus, these moving operative components of the tilt system 132 are shielded against exposure to dust, dirt, water, and other contaminants, and also such that lubricants and/or protective coatings are shielded from environmental influences which might induce their removal leading to reduced ease of use and longevity of the tilt system 132. The encasement of the moving operative components of the tilt system 132 also provides safety advantages as the moving components are shrouded, preventing contact with users or their clothing which reduces the likelihood, for example, of pinching injuries which might otherwise occur during use of the umbrella assembly 100. Other advantages are that the potentially less aesthetic operating components of the tilt system 132 are shielded from view providing a more desirable visual appearance to the users and purchasers of the umbrella assembly 100. Yet other advantages are that the interconnecting member 116 may be provided solely as an interconnecting fixedly attached structural member between the coupler 120 and the tilt assembly 126 and is not directly involved in pivoting or jointed movement to provide greater overall structural strength and stability to the umbrella assembly 100. This also provides the capability of reduced manufacturing costs offering greater profit margins to the manufacturer and/or reduced cost to the end consumer. The various components of the umbrella assembly 100 further comprise relatively high strength and corrosion resistant materials, such as aluminum, plastics, stainless steel, etc., such that the umbrella assembly 100 is weather resistant throughout extended exposure to the elements.

Although the foregoing description of the preferred embodiment of the present invention has shown, described, and pointed out the fundamental novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. An umbrella assembly, comprising:

a support pole assembly comprising:

a first, generally vertically extending support pole; and a second support pole having a proximal end and a distal end and being curved therebetween, the second support pole coupled with and extending generally transverse to said first support pole;

a canopy assembly coupled with the second support pole adjacent the distal end; and a tilt assembly comprising:

a transmission; and a drive shaft extending within and rotatble relative to said second support pole, the drive shaft having a first end coupled with the transmission and a second end adjacent to the distal end of the second support pole and coupled to said canopy assembly;

wherein the transmission is operated to transmit a torque to cause rotation of the drive shaft to pivot the canopy assembly relative to the second support pole.

2. An umbrella assembly, comprising:

a support pole assembly comprising:

a first, generally vertically extending support pole; and a second support pole having a proximal end and a distal end and being curved therebetween, the second support pole coupled with and extending generally transverse to said first support pole;

a canopy assembly coupled with the second support pole adjacent the distal end; and a tilt assembly comprising:

a transmission; and a drive shaft housed in said second support pole, the drive shaft having a first end coupled with the transmission and a second end adjacent to the distal end of the second support pole and coupled to said canopy assembly;

wherein the transmission is operated to transmit a torque to cause rotation of the drive shaft to pivot the canopy assembly relative to the second support pole;

wherein the transmission comprises a worm gear.

3. The umbrella assembly of claim 1, wherein the drive shaft comprises a plurality of substantially rigid straight drive shaft members coupled at interposed joints.

4. The umbrella assembly of claim 1, wherein the tilt assembly comprises a driven member and wherein the second end of the drive shaft comprises a drive member configured to direct a force to the driven member of the tilt assembly so as to transmit rotation of the drive shaft to rotation of the tilt assembly.

5. The umbrella assembly of claim 4, wherein at least one of the transmission and a connection between the drive shaft and the transmission provide a reduction function such that the tilt assembly is able to maintain a tilt orientation when no force is applied to the transmission.

6. The umbrella assembly of claim 1, further comprising a crank handle configured to operate about an axis arranged substantially transverse to the drive shaft axis.

7. The umbrella assembly of claim 1, further comprising a cover member coupled with the canopy assembly.

8. The umbrella support of claim 1, wherein the second support pole defines a first length between the proximal and distal ends thereof and the drive shaft comprises a second length between the first and second ends thereof, the first length not being substantially less than the second length.

9. An umbrella assembly, comprising:

a support pole assembly comprising:

a first, generally vertically extending support pole; and a second support pole having a proximal end and a distal end and being curved therebetween, the second support pole coupled with and extending generally transverse to said first support pole;

a canopy assembly coupled with the second support pole adjacent the distal end; and a tilt assembly comprising:

a transmission; and a drive shaft housed in said second support pole, the drive shaft having a first end coupled with the transmission and a second end adjacent to the distal end of the second support pole and couple to said canopy assembly;

wherein the transmission is operated to transmit a torque to cause rotation of the drive shaft to pivot the canopy assembly relative to the second support pole wherein the tilt assembly comprises a driven member and wherein the second end of the drive shaft comprises a drive member configured to direct a force to the driven member of the tilt assembly so as to transmit rotation of the drive shaft to rotation of the tilt assembly; and wherein the driven member comprises a ring gear and the drive member comprises a drive gear engaged with the ring gear.

10. The umbrella assembly of claim 9, further comprising at least one planet gear arranged between the second end of the drive shaft and the ring gear so as to define a planetary gear train and wherein the drive shaft axis is substantially collinear with the tilt assembly pivot axis.

11. An umbrella assembly, comprising:

a support pole assembly comprising:

a first, generally vertically extending support pole; and a second support pole having a proximal end and a distal end and being curved therebetween, the second support pole coupled with and extending generally transverse to said first support pole;

a canopy assembly coupled with the second support pole adjacent the distal end; and a tilt assembly comprising:

a transmission; and a drive shaft housed in said second support pole, the drive shaft having a first end coupled with the transmission and a second end adjacent to the distal end of the second support pole and coupled to said canopy assembly;

a coupler defining a passage within which the second support pole is received and in which the second support pole can be extended and retracted relative to the first support pole, the coupler being configured to selectively engage the second support pole to fix the position thereof;

a brace member extending between the proximal end of the second support pole and the first support pole, said brace configured to support said second support pole at the proximal end thereof and to accommodate movement of the second support pole relative to the first support pole;

a crank member configured to rotate about a crank axis;

said transmission comprising a drive gear coaxially coupled with said crank member and a driven gear configured to engage said drive gear to convert rotation about the crank axis to rotation about an drive shaft axis substantially perpendicular to the crank axis; and said drive shaft including at least three substantially straight, rigid drive shaft members, each of said drive shaft members being coupled with at least one other drive shaft member to transmit rotational motion from the first end to the second end thereof;

wherein the transmission is operated to transmit a torque to cause rotation of the drive shaft to pivot the canopy assembly relative to the second support pole.

12. The umbrella assembly of claim 11, further comprising a tilt drive gear coupled with the second end of the drive shaft and a tilt driven gear coupled with the canopy assembly.

13. A sunshade comprising:

a support pole assembly, comprising:

a supporting pole having a lower end and an upper end;

a holding sleeve pivotally connected to the upper end of the supporting pole;

a suspending tube slidably extended through the holding sleeve and including a first end and a second end;

a canopy assembly coupled with the second end of the suspending tube for suspending a canopy, the canopy assembly including an upper central member having a plurality of ribs attached thereto for supporting a canopy, and a lower central member having a plurality of struts attached thereto for supporting the ribs;

a linkage extending between the first end and the second end of and within the suspending tube and coupled with said canopy assembly;

a crank member coupled with the support pole assembly, wherein the linkage is configured to be rotated when the crank member is rotated, whereby the canopy assembly is tilted relative to the suspending tube about an axis intersecting the suspending tube, and a transmission configured to convert rotation of the crank member into rotation of the linkage and wherein the linkage includes at least three links pivotably coupled together.

14. The umbrella assembly of claim 13, further comprising a cover member coupled with the canopy assembly.

15. An umbrella assembly comprising:

an extendable canopy assembly;

a generally vertically extending support structure;

a generally horizontally extending interconnecting structure interconnecting the canopy assembly and vertically extending support structure so as to suspend the canopy assembly and a tilt adjustment system comprising a plurality of drive rotatable shaft sections articulated together and being disposed within the horizontal extending interconnecting structure, said tilt adjustment system enabling the canopy assembly to be tilted both in a first direction inwards and outwards with respect to the vertically extending structure as well as in a second direction that is side to side different than the first direction.

16. The umbrella assembly of claim 15, wherein the tilt adjustment system resists variation of the side to side tilt of the canopy assembly, absent user actuation of the tilt adjustment system.

17. The umbrella assembly of claim 16, wherein the tilt assembly comprises a tilt actuator and wherein the tilt assembly is configured such that movement of the tilt actuator is mechanically reduced with respect to the side to side tilt of the canopy assembly so as to provide the resistance to variation of the side to side tilt.

18. The umbrella assembly of claim 15, further comprising an erection assembly such that a user can open and close the extendable canopy assembly.

19. The umbrella assembly of claim 15, wherein the generally horizontally extending interconnecting structure is hinged to the generally vertically extending structure so as to provide the inwards and outwards tilting of the canopy assembly.

20. A tilt system for an umbrella assembly, the tilt system comprising:

a transmission assembly having an input and an output;

a crank handle connectable to the input of the transmission assembly;

a drive shaft assembly configured to be operated within an arcuate support pole, the drive shaft assembly including a plurality of driving sections articulated together to define a drive shaft axis and being rotatably connected at a first end to the output of the transmission assembly; and a tilt mechanism connected to a second end of the drive shaft assembly such that user actuation of the crank handle induces the tilt assembly to pivot inwards and outward about an axis generally parallel with the drive shaft axis to a tilt orientation.

21. The tilt system of claim 20, wherein the tilt system defines a force transmission assembly operably interconnected between the crank handle and the tilt mechanism such that user force provided to the crank handle in a first adjustment direction induces the tilt mechanism to pivot about the tilt axis to a corresponding first tilt orientation and wherein the force transmission assembly resists restoring forces transmitted to the tilt mechanism so as to maintain the first tilt orientation.

22. An umbrella assembly comprising:

an extendable canopy assembly;

a generally vertically extending support structure;

a generally horizontally extending interconnecting structure interconnecting the canopy assembly and the vertically extending support structure so as to suspend the canopy assembly away from the vertical extending support structure, and such that the canopy assembly can be tilted both inwards and outwards in a first plane with respect to the vertically extending structure and parallel to the interconnecting structure, and as well as in a second plane that is substantially perpendicular to the first plane; and a tilt adjustment system disposed along the horizontal extending interconnecting structure for adjusting the tilt of the canopy assembly in the second plane;

wherein the interconnecting structure comprises an arcuate portion and wherein the tilt adjustment system comprises a plurality of drive shaft sections articulated together and extending within the arcuate portion of the interconnecting structure.

* * * * *

UNITED STATES PATENT AND TRADEMARK OFFICE

CERTIFICATE OF CORRECTION

PATENT NO. : 7,533,680 B2
APPLICATION NO. : 11/066132
DATED : May 19, 2009
INVENTOR(S) : Oliver Joen-an Ma It is certified that error appears in the above-identified patent and that said Letters Patent is hereby corrected as shown below:

Title page (Item 30), line 1, please change "2004 2 0021402 U" to --2004 2 0020402.X--.

Title page (Item 56), Page 2, Col. 2, line 25, Under Other Publications, please change "Centilever" to --Cantilever--.

At column 9, line 23, please change "dirve" to --drive--.

At column 11, line 16, In Claim 1, please change "rotatble" to --rotatable--.

At column 12, line 15, In Claim 9, please change "couple" to --coupled--.

At column 12, line 19, In Claim 9, please change "pole" to --pole;--.

At column 13, line 39, In Claim 15, please change "assembly" to --assembly,--.

At column 13, line 46, In Claim 15, please change "drive rotatable" to --rotatable drive--.

At column 14, line 27, In Claim 20, please change "outward" to --outwards--.

At column 14, line 38, In Claim 22, please change "assembly" to --assembly,--.

Signed and Sealed this

Twenty-second Day of December, 2009

David J. Kappos

David J. Kappos
*Director of the United States Patent and Trademark Office*